US011644027B2

(12) United States Patent
Ligenfelter et al.

(10) Patent No.: US 11,644,027 B2
(45) Date of Patent: May 9, 2023

(54) ELECTRONIC TORQUE AND PRESSURE CONTROL FOR LOAD SENSING PUMPS

(71) Applicant: Danfoss Power Solutions Inc., Ames, IA (US)

(72) Inventors: Kevin Ligenfelter, Nevada, IA (US); Gary LaFayette, Saint Joseph, MI (US)

(73) Assignee: Danfoss Power Solutions Inc., Ames, IA (US)

( * ) Notice: Subject to any disclaimer, the term of this patent is extended or adjusted under 35 U.S.C. 154(b) by 645 days.

(21) Appl. No.: 15/120,900

(22) PCT Filed: Mar. 18, 2015

(86) PCT No.: PCT/IB2015/000360
§ 371 (c)(1),
(2) Date: Aug. 23, 2016

(87) PCT Pub. No.: WO2015/140622
PCT Pub. Date: Sep. 24, 2015

(65) Prior Publication Data

US 2016/0363117 A1 Dec. 15, 2016

Related U.S. Application Data

(63) Continuation of application No. 14/220,201, filed on Mar. 20, 2014, now abandoned.

(51) Int. Cl.
*F04B 49/06* (2006.01)
*F04B 1/29* (2020.01)
(Continued)

(52) U.S. Cl.
CPC ..... *F04B 49/065* (2013.01); *F04B 1/295* (2013.01); *F04B 1/324* (2013.01); *F04B 49/12* (2013.01)

(58) Field of Classification Search
CPC .... F04B 1/29; F04B 1/295; F04B 1/32; F04B 1/325; F04B 49/022; F04B 49/03;
(Continued)

(56) References Cited

U.S. PATENT DOCUMENTS 4,057,073 A * 11/1977 Adams ..... F15B 11/162 137/118.06
4,456,434 A * 6/1984 El Ibiary ..... F04B 1/324 137/625.65
(Continued)

FOREIGN PATENT DOCUMENTS

CN 102782321 A 11/2012
CN 103423224 A 12/2013
(Continued)

OTHER PUBLICATIONS

International Search Report for PCT Serial No. PCT/IB2015/000360 dated Jun. 23, 2015.
(Continued)

*Primary Examiner* — Dominick L Plakkoottam
*Assistant Examiner* — Charles W Nichols
(74) *Attorney, Agent, or Firm* — McCormick, Paulding & Huber PLLC

(57) ABSTRACT

A pump control system, comprising: a motor (12) configured to drive a pump (14); a pressure relief valve (22) in fluid communication with the pump (14); a torque control valve (32) connected to a swashplate of the pump (14) and in fluid communication with the pressure relief valve (22); a swashplate angle sensor (36) connected to the swashplate (34); and a computer (40) connected to the swashplate angle sensor (36) and the pressure relief valve (22) wherein the computer (40) controls the pressure relief valve (22) based upon
(Continued)

swashplate displacement to achieve maximum system pressure. The corresponding method of controlling is also disclosed.

16 Claims, 11 Drawing Sheets

(51) Int. Cl.
*F04B 1/32* (2020.01)
*F04B 1/295* (2020.01)
*F04B 1/324* (2020.01)
*F04B 49/12* (2006.01)

(58) Field of Classification Search
CPC ..... F04B 49/065; F04B 49/08; F04B 49/12; F04B 2205/05; F04B 1/324
See application file for complete search history.

(56) References Cited

U.S. PATENT DOCUMENTS 4,559,777 A * 12/1985 Leiber ..... B60G 17/0408 60/422
4,801,247 A 1/1989 Hashimoto et al.
5,819,643 A * 10/1998 McIlwain ..... A01F 15/0825 100/43
9,091,040 B2 7/2015 Peterson et al.
2002/0073699 A1 6/2002 Nishimura et al.
2002/0108486 A1 8/2002 Sannomiya et al.
2002/0176784 A1 11/2002 Du
2003/0156949 A1 8/2003 Shimomura et al.
2003/0226291 A1 12/2003 Naruse et al.
2005/0160726 A1 7/2005 Lonn
2008/0236156 A1* 10/2008 Kakino ..... F15B 15/18 60/443
2009/0031891 A1 2/2009 Brinkman et al.
2009/0185915 A1* 7/2009 Sanger ..... F04B 9/117 417/46
2012/0029775 A1* 2/2012 Peters ..... B23K 9/1006 701/50
2013/0312397 A1 11/2013 Callaway et al.
2014/0033691 A1* 2/2014 Peterson ..... E02F 9/2235 60/327
2015/0017029 A1* 1/2015 Jung ..... F15B 11/0423 417/307
2016/0002889 A1 1/2016 Kajita et al.
2016/0363117 A1 12/2016 Ligenfelter et al.

FOREIGN PATENT DOCUMENTS

DE 10 2012 214 408 A1 3/2013
JP 60001053 A 1/1985
JP 2002357177 A 12/2002
JP 2012137157 A 7/2012
WO 2011107190 A1 9/2011
WO 2015140622 A1 9/2015

OTHER PUBLICATIONS

Japanese Notice of the Reasons for Refusal and English Translation for Serial No. 2016-556807 dated Mar. 20, 2019.
Japanese Office Action and its English translation for corresponding JP Application No. 2020-114637 dated Aug. 10, 2021.
Japanese Office Action and its English translation for corresponding JP Application No. 2016-556807 dated Oct. 26, 2021.

* cited by examiner

ELECTRONIC TORQUE AND PRESSURE CONTROL FOR LOAD SENSING PUMPS

CROSS REFERENCE TO RELATED APPLICATION

This application is entitled to the benefit of and incorporates by reference subject matter disclosed in the International Patent Application No. PCT/IB2015/000360 filed on Mar. 18, 2015; and U.S. application Ser. No. 14/220,201 filed Mar. 20, 2014.

BACKGROUND

This invention is directed toward a control for a load sensing pump. Use of a mechanical torque control is well known in the art. In known systems the swash plate angle is mechanically connected to a relief valve where the relief set point changes with the swash plate angle. One problem with this system is the inability to change the torque set point quickly for example to account for accessory loads on the engine or reduced torque at low engine speed. Another problem with known systems is the inability to change max pressure set point on the fly.

For example, a traditional load sensing system is shown in FIG. 1. A traditional load sensing circuit uses a variable displacement open circuit pump with an integral control that uses a feedback pressure to maintain a given pressure drop across a variable orifice in the system. This given pressure drop is dictated by the setting in the control at the pump, in the example in FIG. 1 it is set to 20 bar. The pump will provide the needed flow up to its maximum capability to try and maintain a 20 bar drop in pressure across the variable orifice. This 20 bar pressure drop will be referred to as Load Sensing Margin Pressure (LS pressure).

Output pressure of the pump is equal to the required pressure to lift a load plus the drop across the variable orifice. If the pressure required to lift a certain load is equal to 180 bar, the resultant output pressure of the pump would be equal to 200 bar in this example.

Input torque to the pump that must be supplied by the engine is calculated by taking the product of the output pressure of the pump as well as the displacement required to maintain the LS pressure drop across the orifice. A sample of this calculation is shown below in Example 1.

Example 1.)

$$\text{Pump Torque} = \frac{\boxed{200}\ \text{bar} \times \boxed{45}\ \text{cc/rev}}{62.8 \times \boxed{100}\ \%} = \boxed{143.31}\ \text{Nm}$$

Pump Torque Calculation

As either pressure or displacement (flow) of the pump increase, the input torque required will increase as a result. Often, when high flows and pressures are commanded of the pump, the torque requirement placed on the prime mover exceeds the capability resulting in a stalled engine. In addition to stalling where the input torque to the pump exceeds the torque output capabilities of the engine driving, the result is operator frustration and/or poor performance. Systems with dual set-points are known but are very complex and expensive. Therefore, a need exists in the art for a system that addresses these deficiencies.

SUMMARY

An objective of the present invention is to provide a control for a load sensing pump that can change a torque setting quickly.

Another objective of the present invention is to provide a control for a load sensing pump where a maximum pressure set point can be changed on the fly.

A still further objective of the present invention is to provide a control for a load sensing pump that reduces the possibility of the engine stalling.

These and other objectives will be apparent to one of ordinary skill in the art based upon the following written description, drawings, and claims.

An electric torque and pressure control for load sensing pumps includes a pump with a swash plate angle sensor. The pump is connected in line with a pressure compensated load sensing control having an electrically variable pressure relief valve and orifice. Connected to the circuit is an engine speed sensor and a micro-controller. The micro-controller has software that controls a pressure relief setting of the electrically variable pressure relief valve in the pressure sensing control based upon signals from the swash plate sensor and the engine speed sensor.

DETAILED DESCRIPTION

Figure 1:
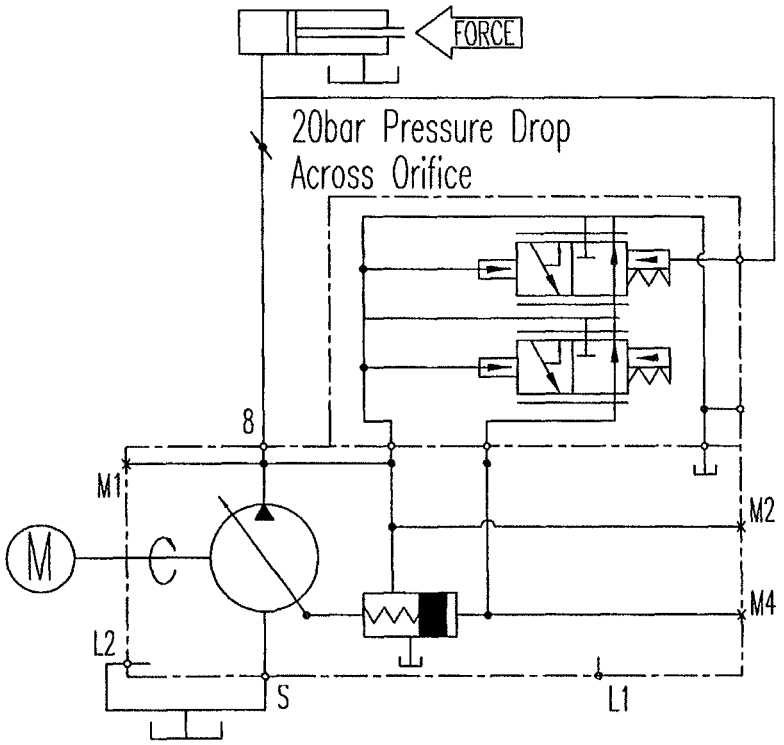
Prior Art Fig. 1
FIG. 1 is a schematic view of a prior art load sensing system.
Figure 2:
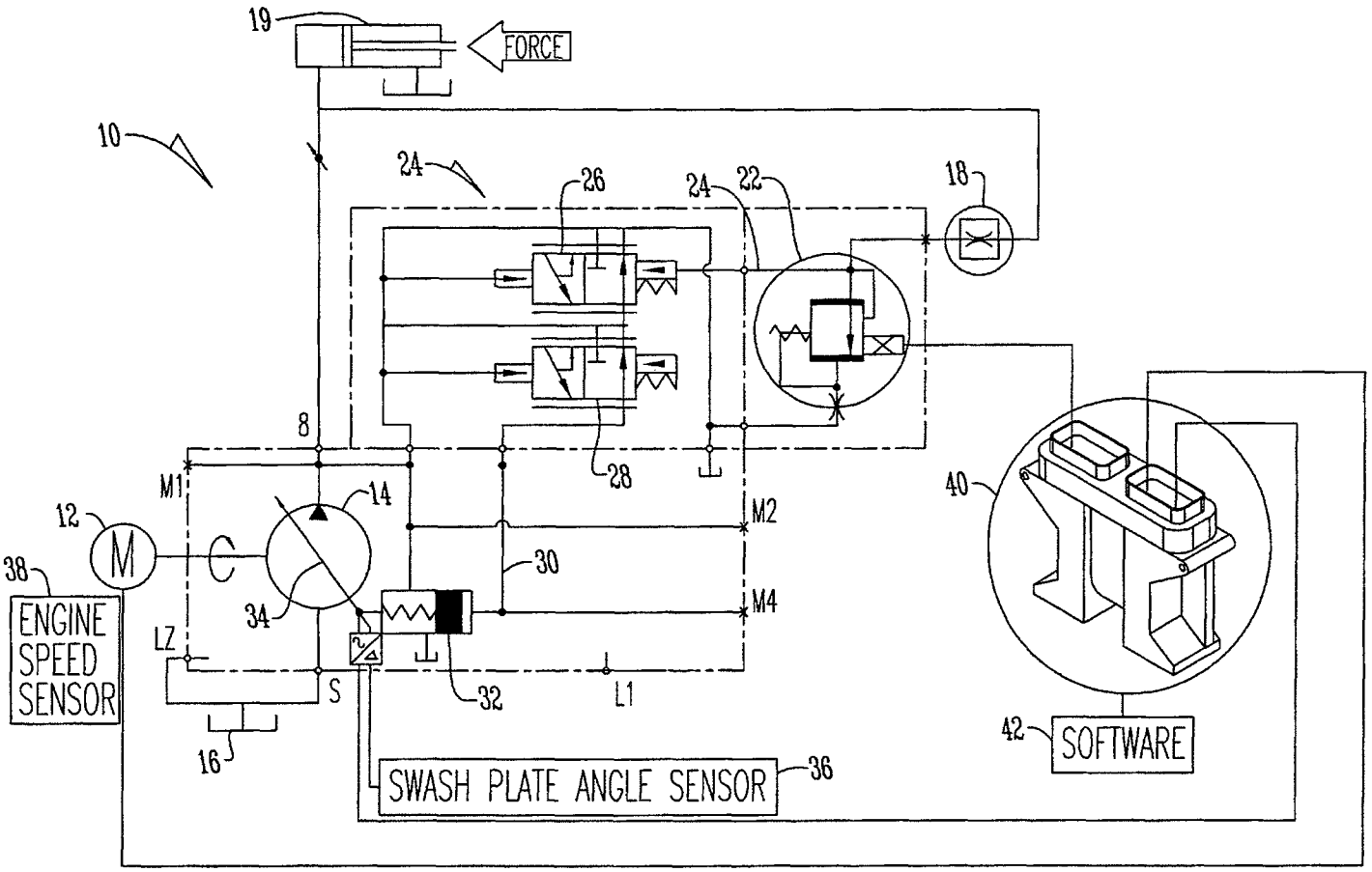
FIG. 2 is a schematic view of an electronic torque/pressure control circuit.

Referring to the Figures, an example of a pump control system 10 includes a motor 12 configured to drive pump 14. In one embodiment, motor 12 is a gear box transmission from an engine power take-off and pump 14 is a variable axial piston pump. Pump 14 delivers and pressurizes fluid from tank 16 to a control valve 18 and cylinder 19 at a system pressure through flow line 20.

Connected downstream of control valve 18 to flow line 20 is a pressure relief valve 22. Also connected to flow line 20 by flow line 24 is a pressure limiting compensation valve 28 is connected to and feeds the pressure limiting compensation valve 26. The load sense compensation valve 28 is also connected to flow line 20 and pump discharge line 30 are connected to torque control valve 32 which is connected to and controls the displacement of a swashplate 34 of pump 14. Connected to the swashplate 34 is a swashplate angle sensor 36 and connected to the motor 12 is an engine speed sensor 38. Both the angle 36 and speed 38 sensors are connected to a computer 40 having software 42. The computer 40 is connected to and controls pressure relief valve 22.

In operation, when resistance is encountered in the circuit that raises the force on the cylinder 19 and creates a resultant pressure in the circuit and at the pump 14 the swashplate sensor 36 provides a signal to the computer 40 providing information on the angle of the swashplate 34. The software 42 calculates a maximum pressure that would result in a torque level the engine is capable of producing at the given displacement. The computer then sends a signal to the pressure relief valve 22 providing the correct current to the pressure relief valve 22 to achieve maximum pressure. The pressure relief valve 22 is adjusted to relieve LS pressure.

The high pressure on the pump side of torque control valve 32 destrokes the pump 14. As the pump destrokes, the software 42 reduces the current command to the pressure relief valve 22 increasing LS pressure. The pump 14 continues to destroke and the LS pressure continues to increase based on swashplate 34 angle until a desired difference between pump output and LS pressure is reached. This permits the system 10 to deliver maximum pressure for a given displacement without engine stall.

Basic ETL Circuit Operation

As an example, oftentimes with load sensing open circuit systems, the torque requested to be supplied by the engine exceeds the engine's capabilities. When this happens, the operator is required to reduce his commands, slowing the machine which can make it difficult to operate efficiently. Alternatively, the engine simply stalls requiring the operator to restart the machine.

Starting with the engine torque calculation in example 1.

Example 1.)

$$\text{Pump Torque} = \frac{\boxed{200}\ \text{bar} \times \boxed{45}\ \text{cc/rev}}{62.8 \times \boxed{100}\%} = \boxed{143.31}\ \text{Nm}$$

Pump Torque Calculation

Assume the operator of that machine were commanding this operation, and then encountered some resistance to the circuit that raised the force on the cylinder, and the resultant pressure in the circuit to 300 bar (320 bar at the pump). With no change in the valve command, the pump will try and maintain the same output flow at the new higher pressure. The resulting new torque requirement to the engine is shown in Example 2.

Example 2.)

$$\text{Pump Torque} = \frac{\boxed{320}\ \text{bar} \times \boxed{45}\ \text{cc/rev}}{62.8 \times \boxed{100}\%} = \boxed{229.30}\ \text{Nm}$$

Pump Torque with Added Load

If the engine on the machine is only capable of 150 Nm of output torque, this new load and sustained flow command would overwhelm the engine and result in a stalled condition if the operator continued the command. With basic ETL, the system 10 can control the stroke of the pump 14 by regulating the LS pressure in the pressure relief valve 22, in turn maintaining a torque level at or below the maximum torque that the engine can provide and keeping the engine from stalling.

Figure 3:
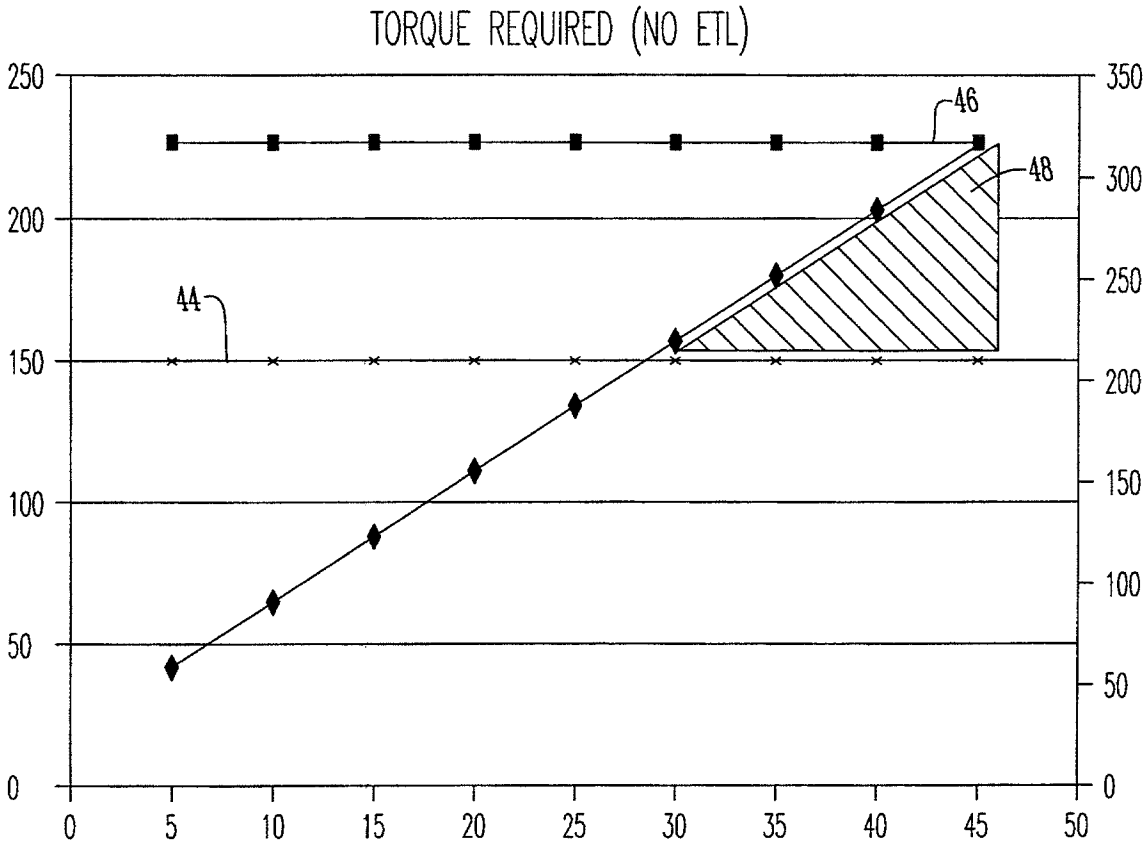
FIG. 3 is a chart comparing pump displacement with maximum torque pressure.

As shown in FIG. 3, as an example there is a large area in which the pump 14 is capable of operating in, that would result in an engine stall condition. Line 44 shows the maximum torque level that the engine is capable of delivering to the pump 12. The line 46 shows the constant maximum pressure limit usually employed with a traditional load sense system.

Figure 4:
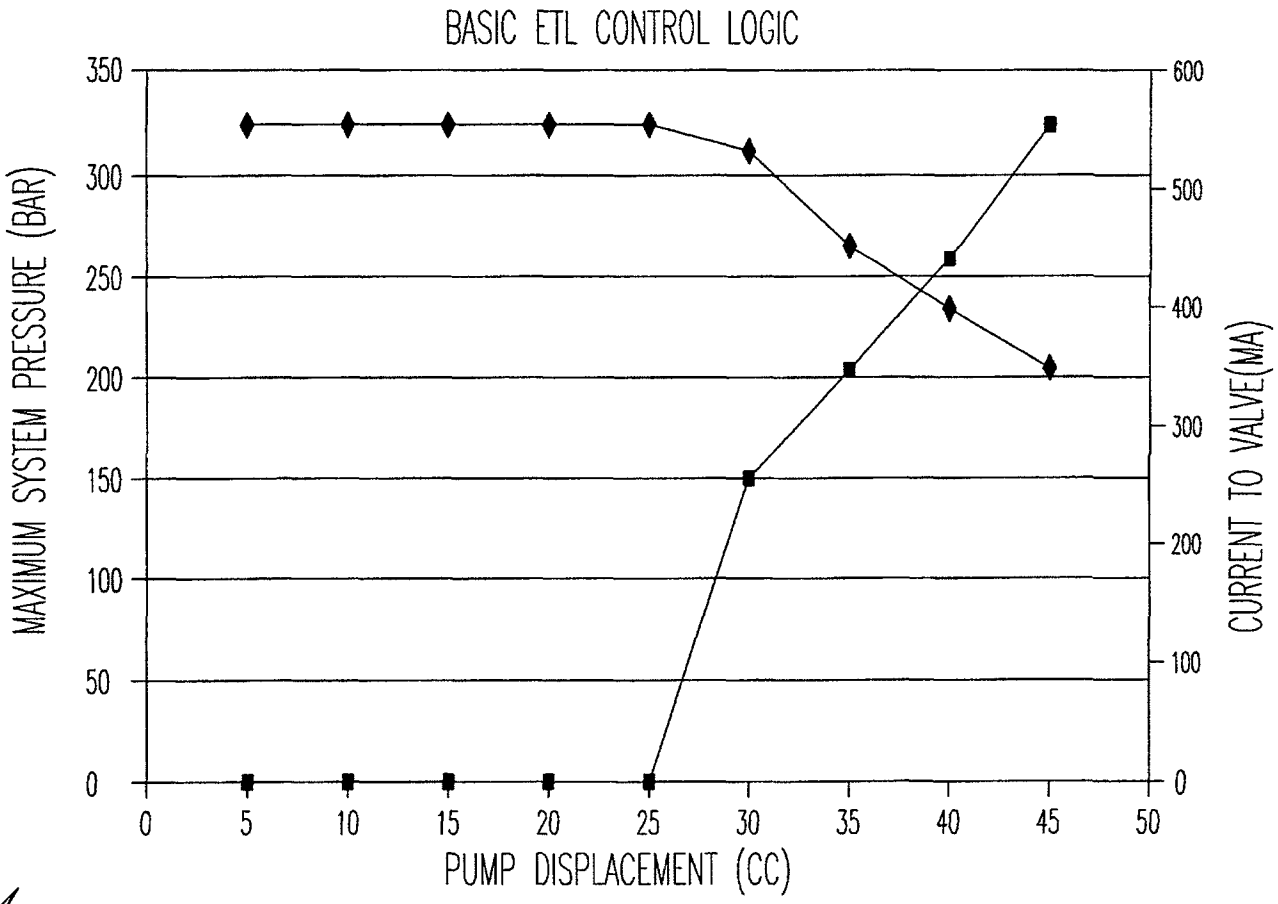
FIG. 4 is a chart comparing pump displacement with current to valve.
Figure 5:
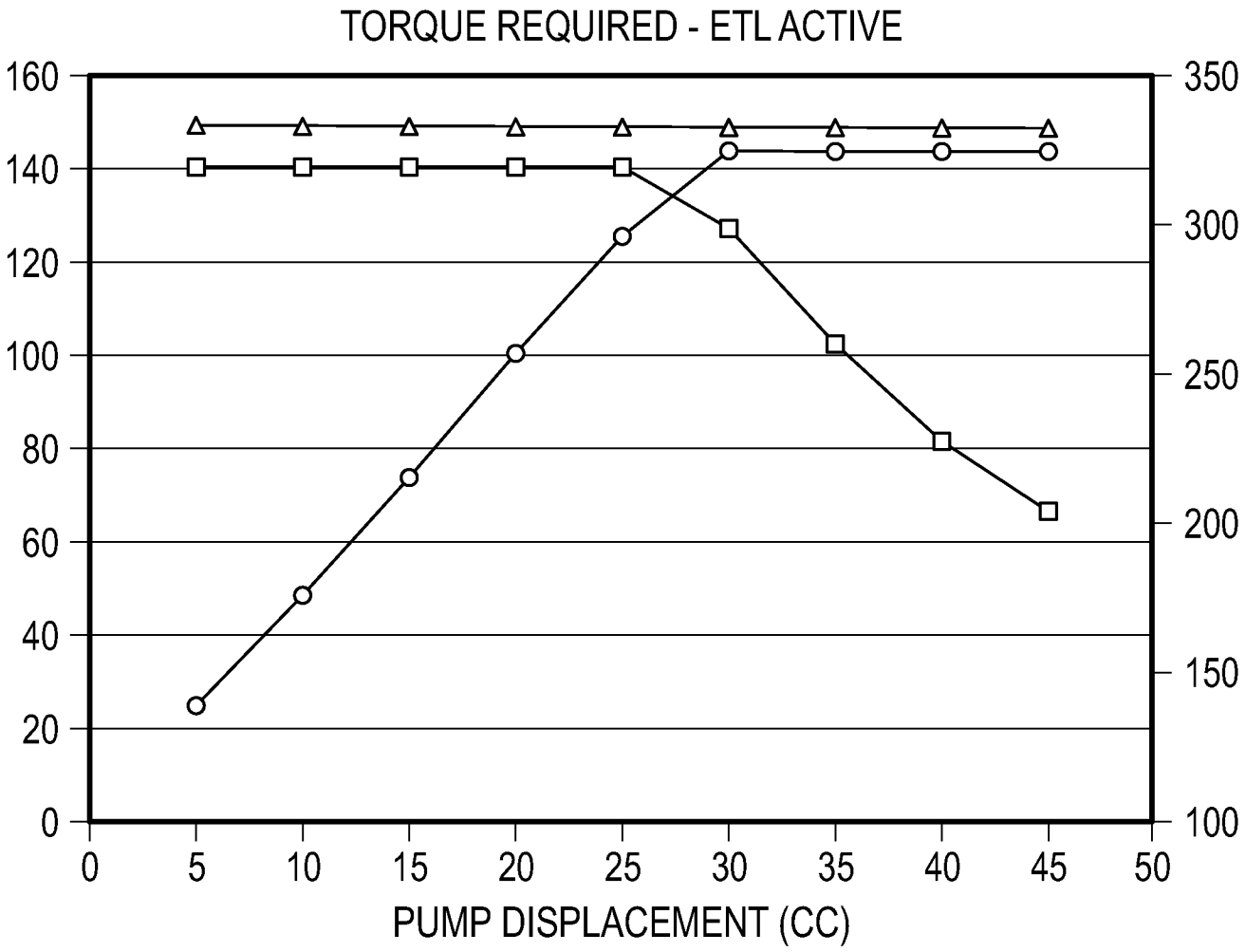
FIG. 5 is a chart comparing pump displacement with pressure.
Figure 6:
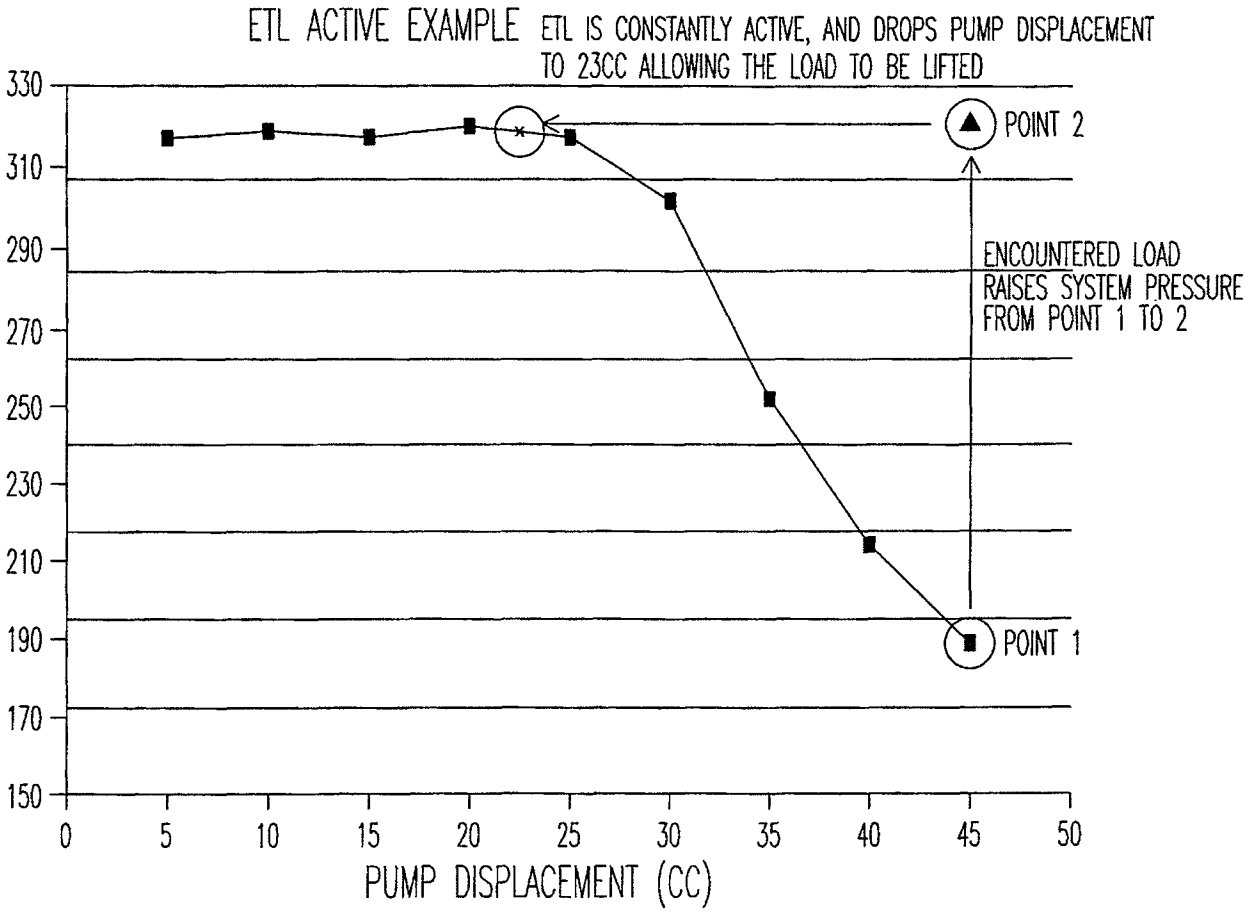
FIG. 6 is a chart comparing pump displacement with system displacement.
Figure 7:
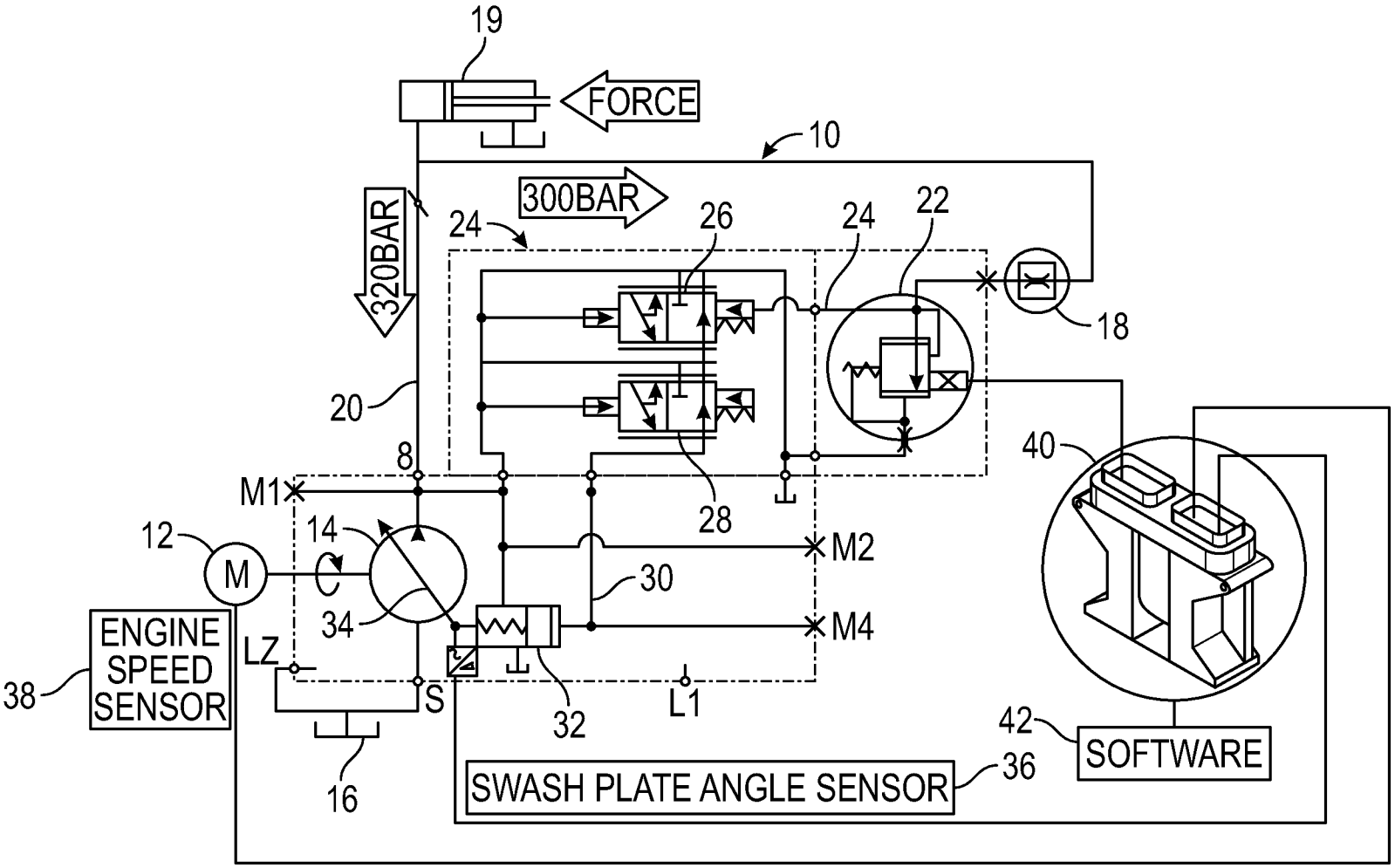
FIG. 7 is a schematic view of an electronic torque/pressure control circuit.

During machine operation, the software 42 is continually monitoring the angle of the swash plate in the pump 14. The software 42 uses the swash plate angle to calculate a maximum pressure that would result in a torque level that the engine could produce at the given displacement, and sends the correct current to the proportional pressure relieving valve 22 in the pump control to achieve that maximum pressure. Shown in FIG. 4, as swash plate angle increases, the current to the pressure relief valve 22 increases (decreasing its setting) limiting the amount of torque the pump 14 can absorb.

Using this control logic, electronic torque limiting is able to clip off the area 48 in FIG. 3 that results in engine stalling, and instead allows the hydraulic system 10 to always deliver maximum possible pressure for a given displacement without engine stalling.

Revisiting the example once again, this time with ETL active;

1.) The operator commands a flow and displacement equal to our first example: 45 cc's and 200 bar.

2.) The machine encounters a load which raises system pressure to 320 bar.

3.) ETL is constantly active, and the pump 14 quickly destrokes to an angle that will allow the load to be lifted without stalling the engine.

ETL Operation from a Mechanical Standpoint

1.) The operator commands a flow and displacement equal to our first example: 45 cc's and 200 bar 2.) The machine encounters a load which raises load pressure to 300 bar (320 bar seen at pump)

3.) The operator maintains the same command. 300 bar load pressure is transferred down the LS line 20 to the electronically proportional pressure relief valve 22. 320 bar pressure is transferred through the variable orifice to the pump 14 and to the pump controls 32.

4.) The LS pressure is relieved at a setting calculated by the micro controller 40 based on the angle of the swash plate 34. This lowers the pressure on the LS side of the pump control 32.

5.) High pressure on the pump side of the pump control 32 shifts the control to port oil to the servo piston, destroking the pump 14.

6.) As the pump 14 de-strokes, the software 42 is reducing current command to the LS variable relief valve 22, allowing LS pressure on the pump control 32 to increase.

7.) The pump 14 will continue to de-stroke and the LS pressure will continue to increase based on swash plate angle until a 20 bar delta between pump output and LS pressure is reached.

Torque Control with Load Holding Valves

A system comprised of a traditional mechanical torque control with multiple functions and a load holding or load drop check valve can encounter conditions when the pump outlet pressure is limited below a pressure that can lift the "checked" load, and when that function is enabled, it is unable to move. The use of electronic torque control along with electronically controlled valves, a pressure transducer, and a software solution can alleviate this problem.

Figure 8:
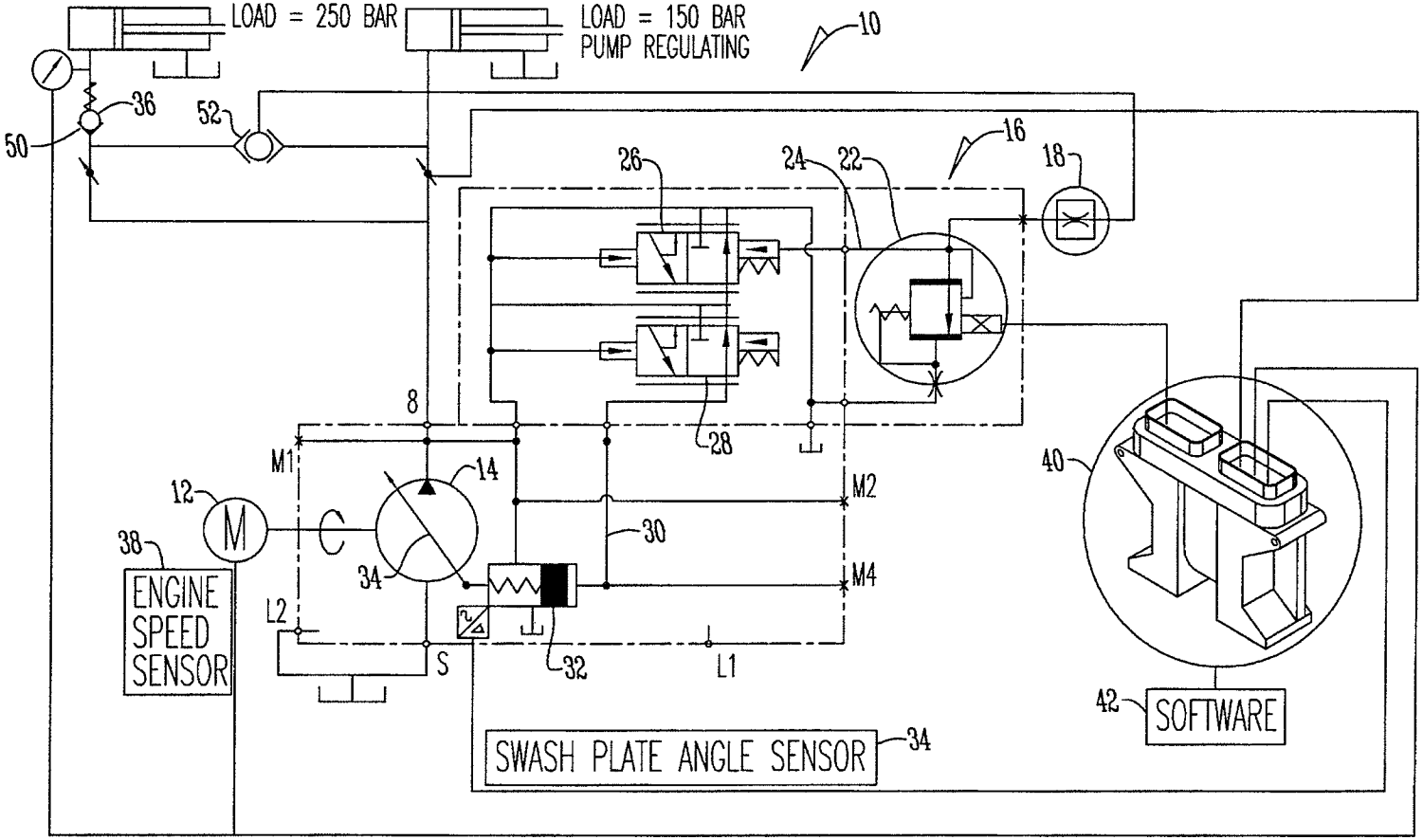
FIG. 8 is a schematic view of a torque control circuit with load holding valves.

In FIG. 8, for example, the valve 22 for function 1 is opened and demands a pressure of 150 bar to lift the load and a flow that together will exceed the current torque limit setting of the ETL software 42. In this scenario, the ETL will be regulating the displacement of the pump 14. If the valve 22 for function 2 is opened, which requires a pressure of 250 bar to lift the load, the check valve 50 will continue to support the load, and the required pressure will not be communicated back to the pump control 32 to allow ETL to function properly and lift the load. To solve this problem, a pressure transducer 52 is added to monitor the pressure required to lift function 2 when it is commanded by the operator. When a command is issued for function 2, but the current torque set point of the pump 14 does not allow the load to be lifted, the software 42 will pull back the command of function 1 (or multiple other functions) until the pump displacement is decreased to a point that will allow a high enough pressure to lift the load on function 2. In considering this function, one must remember that the ETL software 42 continuously monitors swash plate angle and will increase the pressure limit of the pump 14 as pump displacement decreases so as to maintain an acceptable torque level to the engine.

Torque Control on Pressure Compensated Pumps

Figure 9:
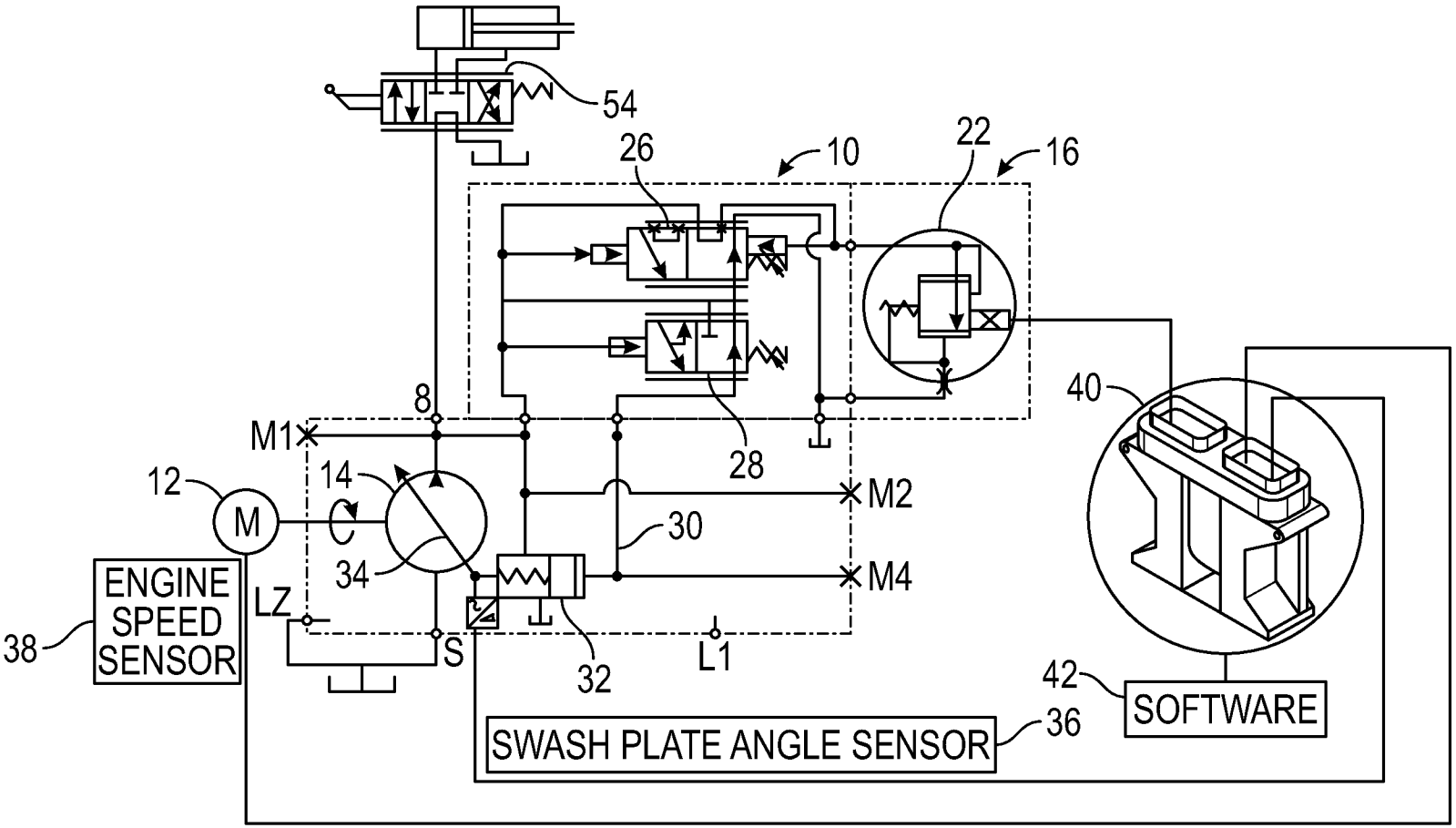
FIG. 9 is a schematic view of a torque control circuit with a pressure compensated pump.

In backhoe systems it is common to use a pressure compensated pump with torque limiting pump control and a manually operated open center valve stack. All the advantages previously listed in the load sensing circuit still apply to the pressure compensated system. Additionally, as shown in FIG. 9, it is common to have a special dump valve 54 to reduce the set point of the PC pump 14 during engine cranking (primarily in cold conditions). The issue is that when the oil is cold, there is a substantial amount of pressure required to push the oil through the open center valve. Without any additional components the torque limiting system can reduce the pressure set point of the PC during cranking to reduce outlet pressure and displacement, thus reducing the load on the engine's starter.

Torque Control and Margin Erosion Across Valves

In proportional valve groups, especially compensated valves, the design of the valves usually requires a minimum pressure drop across the valve (or margin) for it to operate properly, and properly communicate the load sense pressure back to the pump 14. As discussed previously, torque control functions by shifting the margin across the valve to an orifice located in the pump control 32. As torque control further reduces torque, the margin across the valve 22 can drop to levels where it may not function correctly. This can be especially noticed during low engine RPM operation where the level of torque reduction is quite high.

Figure 10:
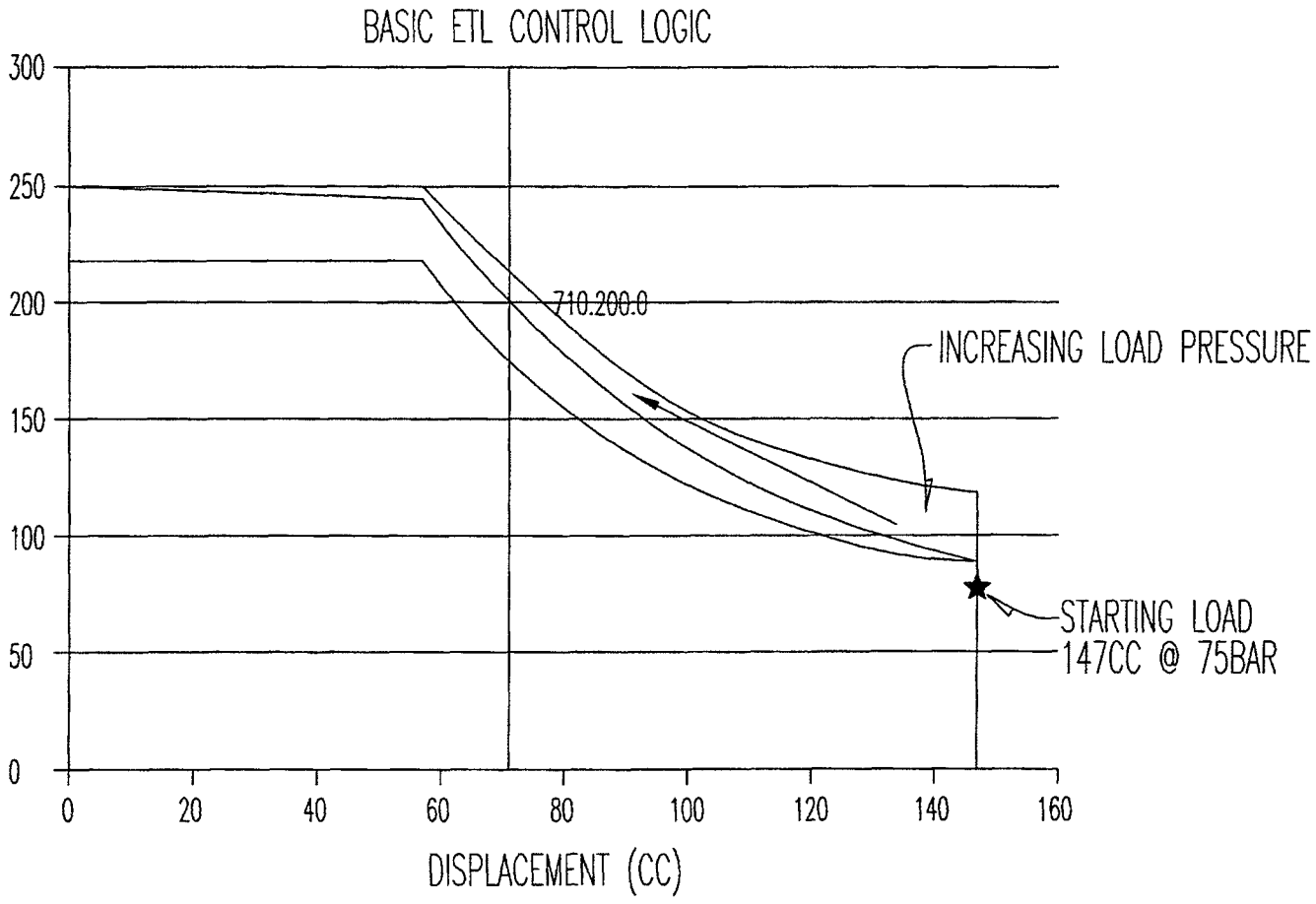
FIG. 10 is a chart showing a margin allocation in torque control by comparing displacement with pressure.

FIG. 10 outlines the pump outlet pressure (Ppump), the actual load pressure (PLS) which is the pressure actually working on the load, and the pressure seen at the load sense control of the pump 14 (Pctrl) which is after the relief valve 22 and orifice.

A starting condition shown by the X at the end of the arrow requires a displacement of 147 cc to maintain the margin across the valve 22 and a pressure of 75 bar to lift the load. At this condition, the point is not under influence of the torque control, and the entire margin is satisfied by the drop across the proportional control valve 22. If the command to the valve remains the same, as the load pressure increases, it will first travel upward until the PLS line turns to the left. It is at this point that torque control is starting to become active and relieve pressure at the control. As the pressure continues to increase (following the PLS line), the pump 14 continues to destroke which will reduce the flow through the control valve 22. As previously stated this valve 22 is still receiving the same command, so the reduction in flow lowers the pressure drop across this valve 22. The total pressure drop between the pump outlet (Ppump) and (Pctrl) is still being satisfied by the increasing pressure drop across the orifice in the LS control 32, thereby satisfying the required margin to keep the pump 14 from going into stroke. As the pressure continues to rise, one can see that the pressure drop to satisfy the margin requirement of the pump 14 continues to shift away from the control valve 22 and to the orifice at the LS control 32 on the pump 12. The point at which it reaches the vertical line is the point at which the margin across the control valve 22 has dropped to a point where it may no longer function correctly. It is at this point machine performance may begin to suffer, and further pump angle reduction can cause poorer valve performance.

To solve this problem, a method of controlling the total valve flow request has been utilized. The employed algorithm seeks to limit the valve opening so that the torque limiter is not impacted by margin erosion while avoiding unnecessarily limiting the valve output when the torque limiter is not actively regulating. By using electronically controlled valves in conjunction with the pump angle sensor 36 and a microcontroller 40, it is possible to manipulate the shift of the margin from the control valves 22 to the orifice in turn, allowing further destroking the pump 14 to meet load and output torque requirements.

Looking once again at FIG. 10, we can take a closer look at the vertical line in the graph which represents the minimum margin requirement for proper control valve function (let's assume 7 bar for this example). That means the difference between the middle curve (PLS) and the upper curve (Ppump) is 7 bar at the intersections of the vertical line. If the load pressure were to continue under the steady valve command in this example, the standard torque control would continue to destroke the pump 14 to the left of this line and control valve performance would start to deteriorate. The creation of these performance lines are based on the initial conditions of the valve 22, load, and pump 14. If we were to change the opening of the control valve 22 (flow request) it is possible to change the nature of these curves, and allow the pump 14 to further destroke without further margin erosion.

Figure 11:
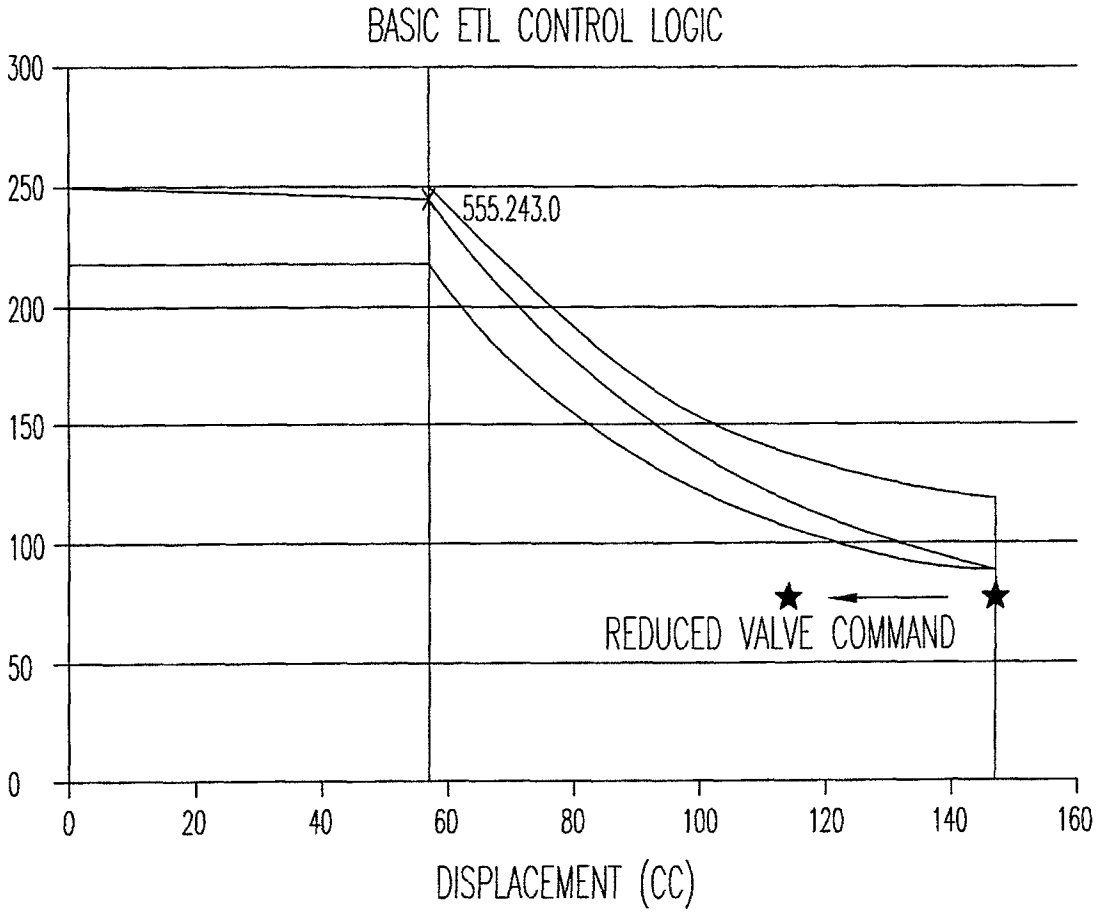
FIG. 11 is a chart showing a margin allocation in torque control by comparing displacement with pressure.

Continuing the example, if the request from the pump 14 is lowered from the full 147 cc to 115 cc, the characteristics of the PLS curve are re-shaped, and in turn changes the shift of margin discussed above. The now slightly more restrictive valve opening increases the relative margin across itself, allowing for further pump destroking meeting the increased load demands. As you can see in FIG. 11, reducing the valve request from 147 cc to 115 cc for this example allows full system pressure to be reached before the margin erosion across the valve becomes an issue.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed:

1. A pump control system, comprising:

a motor configured to drive a pump;

a pressure relief valve in fluid communication with the pump;

a torque control valve connected to and controlling an angle of a swashplate of the pump and in fluid communication with the pressure relief valve to control the angle of the swashplate;

a swashplate angle sensor connected to the swashplate;

an engine speed sensor connected to the motor; and a computer connected to the swashplate angle sensor, the engine speed sensor, and the pressure relief valve, wherein the computer controls the pressure relief valve based upon swashplate displacement and engine speed to achieve maximum system pressure by calculating a maximum pressure that would result in a torque level produced at a given swashplate displacement and engine speed and sending a signal to the pressure relief valve providing a current to achieve the maximum pressure.

2. The system of claim 1 further comprising a pressure transducer that monitors a pressure required for a lift function.

3. The system of claim 1 further comprising a dump valve to reduce a set point of pump engine cranking.

4. The system of claim 1 wherein the computer pulls back a command of at least a first function when a command is issued for a second function and a torque set point of the pump does not allow a load to be lifted until pump displacement is decreased to a point that will have a high enough pressure to lift the load on the second function.

5. The system of claim 4 wherein a pressure transducer monitors pressure required for function 2.

6. The pump control system of claim 1, wherein the pressure relief valve is an electrically variable pressure relief valve.

7. A method of controlling a load sensing pump, comprising the steps of:

monitoring an angle of a swashplate with a swashplate angle sensor and software of a micro-controller;

monitoring engine speed of a motor driving the load sensing pump with an engine speed sensor and software of the micro-controller;

calculating with the software a maximum pressure resulting in a torque level that an engine could produce at a given displacement based on at least the angle of the swashplate and the engine speed; and sending a correct current to a proportional pressure relief valve to achieve maximum pressure, wherein the proportional pressure relief valve is in fluid communication with a torque control valve connected to and controlling the angle of the swashplate.

8. The method of claim 7 further comprising the step of monitoring a pressure required to lift a load with a pressure transducer.

9. The method of claim 8 further comprising the step of decreasing a pump displacement to a point that provides high enough pressure to lift the load when a torque set point does not allow the load to be lifted.

10. The method of claim 7 further comprising the step of reducing a pressure set point for the pump during cranking to reduce outlet pressure, displacement, and a load on an engine's starter.

11. The method of claim 7 further comprising the step of limiting control valve opening so that a torque limiter is not impacted by margin erosion.

12. The method of claim 7 wherein as high pressure de-strokes a pump the computer causes load sensing margin pressure to increase until a desired difference between pump output and load sensing margin pressure is reached.

13. The method of claim 7, wherein the proportional pressure relief is an electrically variable pressure relief valve.

14. The method of claim 7, wherein the step of sending a correct current to a proportional pressure relief valve to achieve maximum pressure comprises sending a signal to the pressure relief valve.

15. A pump control system, comprising:

a pump having a swashplate, the pump configured to be driven by a motor;

a pressure relief valve in fluid communication with the pump;

a torque control valve connected to and controlling an angle of a swashplate of the pump and in fluid communication with the pressure relief valve to control the angle of the swashplate;

a swashplate angle sensor connected to the swashplate;

an engine speed sensor connected to the motor; and a computer connected to the pressure relief valve, the engine speed sensor, and the swashplate angle sensor, the computer controlling the pressure relief valve based upon swashplate angle and engine speed by calculating a maximum pressure that would result in a torque level produced at a given swashplate angle and engine speed and sending a signal to the pressure relief valve providing a current to achieve the maximum pressure.

16. The pump control system of claim 15, wherein the pressure relief valve is an electrically variable pressure relief valve.

* * * * *